US006857460B1

(12) United States Patent
Mowry

(10) Patent No.: US 6,857,460 B1
(45) Date of Patent: Feb. 22, 2005

(54) PORTABLE PAINTBALL BUNKER

(76) Inventor: Todd Mowry, 5120 Coral Wood Dr., Naples, FL (US) 34119

( * ) Notice: Subject to any disclaimer, the term of this patent is extended or adjusted under 35 U.S.C. 154(b) by 0 days.

(21) Appl. No.: 10/641,446

(22) Filed: Aug. 14, 2003

(51) Int. Cl.[7] ..... A47G 5/00
(52) U.S. Cl. ..... 160/351; 160/352; 473/478
(58) Field of Search ..... 160/351, 352, 160/135, 369, 371, 377; 135/117, 143, 144, 151, 115, 901; 473/478, 421

(56) References Cited

U.S. PATENT DOCUMENTS

| | | | | | |
|---|---|---|---|---|---|
| 1,415,482 | A | * | 5/1922 | Reed | 135/100 |
| 3,174,493 | A | | 3/1965 | Gruenberg | |
| 4,069,832 | A | * | 1/1978 | Bingham | 135/143 |
| 4,516,620 | A | * | 5/1985 | Mulhern | 160/351 |
| 4,646,770 | A | | 3/1987 | Lobato | |
| D354,156 | S | | 1/1995 | Tapia | |
| 5,730,666 | A | | 3/1998 | Hudson | |
| 5,842,939 | A | * | 12/1998 | Pui et al. | 473/478 |
| 6,113,507 | A | * | 9/2000 | Padilla | 473/478 |
| 6,145,528 | A | | 11/2000 | Egnew et al. | |
| 6,240,939 | B1 | | 6/2001 | McGee | |
| 6,251,033 | B1 | | 6/2001 | Davidson | |

* cited by examiner

*Primary Examiner*—David Purol
(74) *Attorney, Agent, or Firm*—Charles J. Prescott

(57) ABSTRACT

A portable paintball bunker for temporary deployment atop a playing surface of a paintball game field to provide a shelter for a player from being hit by a paintball shot from a paintball marker of an opposing player. The bunker includes an open perimeter frame assembly formed of straight tubular frame members including one central upright frame member, two diagonal upper edge frame members and two lower ground-supported frame members and connecting fittings for attaching ends of the tubular frame members together to define two substantially upright planar right triangular shaped perimeter frames having a common upright central edge therebetween defined by the central upright frame member. A flexible cover is also provided including two substantially right triangular panels having a common upright margin, each panel extending over one of the perimeter frames. Edge margins of the cover have longitudinal pockets formed to receive one corresponding frame member inserted therein whereby, on deployment, the cover is held and supported with the upright margin positioned against the central upright frame member. Each of the panels is also slightly larger than each perimeter frame causing each panel to sag slightly and to be somewhat untensioned whereby risk of damage caused by propelled paintballs striking thereagainst is substantially reduced.

6 Claims, 5 Drawing Sheets

PORTABLE PAINTBALL BUNKER

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to competitive paintball and more particularly to a portable paintball bunker deployable atop a paintball playing field.

2. Description of Related Art

The game of paintball has grown rapidly in popularity to the point of competition wherein two separate individuals or teams of players, each member carrying a paintball marker, take a playing field in an attempt to shoot the opposing members with a compressed gas propelled paint-filled gelatin or plastic shell structured paintball. When an individual is struck by such a paintball, it explodes leaving clear evidence of a direct or indirect hit in the form of splattered paint.

As disclosed in U.S. Pat. No. 6,251,033 by Davidson, a paintball game field and method of play are there disclosed wherein a plurality of bunkers (46) are deployed around the playing field to provide shelter for each participant during competitive play. These bunkers (46) are shown as being inflatable and are further described generally as being sufficiently large to provide cover for a player.

Tapia, in U.S. Design 354,156 teaches a paintball judge bunker which a field judge would carry during play to defend themselves from propelled paintballs.

The following additional patented devices provide some form of shelter or protection from elements, but are not described or taught to being useful with respect to use on a paintball game field:

U.S. Pat. No. 6,145,528 to Egnew, et al.

U.S. Pat. No. 6,240,939 to McGee

U.S. Pat. No. 5,730,666 to Hudson

U.S. Pat. No. 4,646,770 to Lobato

U.S. Pat. No. 3,174,493 to Gruenberg

The present invention provides a portable paintball bunker for temporary deployment atop a playing surface of a paintball game field which is sized and shaped to provide shelter for at least one player at a time from being struck by a propelled paintball during competitive play. By providing a simple, easily deployable structure of the present invention, orthogonally oriented panels formed of a tubular frame assembly supporting flexible vinyl reinforced polyester sheets sized to provide a sag in each panel, a propelled paintball striking either of the upright panels will simply fall to the ground or be deflected slightly without damaging or piercing through the flexible panel. The sag provided will also substantially de-energize the propelled paintball so that, should it be deflected or ricochet off of a panel surface, the energy level will be sufficiently dissipated so as to render the paintball harmless and ineffective thereafter.

BRIEF SUMMARY OF THE INVENTION

This invention is directed to a portable paintball bunker for temporary deployment atop a playing surface of a paintball game field to provide a shelter for a player from being hit by a paintball shot from a paintball marker of an opposing player. The bunker includes an open perimeter frame assembly formed of straight tubular frame members including one central upright frame member, two diagonal upper edge frame members and two lower ground-supported frame members and connecting fittings for attaching ends of the tubular frame members together to define two substantially upright planar right triangular shaped perimeter frames having a common upright central edge therebetween defined by the central upright frame member. A flexible cover is also provided including two substantially right triangular panels having a common upright margin, each panel extending over one of the perimeter frames. Edge margins of the cover have longitudinal pockets formed to receive one corresponding frame member inserted therein whereby, on deployment, the cover is held and supported with the upright margin positioned against the central upright frame member. Each of the panels is also slightly larger than each perimeter frame causing each panel to sag slightly and to be somewhat untensioned whereby risk of damage caused by propelled paintballs striking thereagainst is substantially reduced.

It is therefore an object of this invention to provide a portable paintball bunker which is easily deployable atop a playing surface of a paintball game field to afford protection for an individual player from being struck by a propelled paintball shot from an opponent's paintball marker.

Another object of this invention is to provide a portable paintball bunker of different heights to afford varying levels of protection in bunkering a player from being struck with a propelled paintball.

Yet another object of this invention is to provide a portable paintball bunker having flexible panels which reduce the likelihood of damage thereto and also deflect and de-energize propelled paintballs to render them ineffective after having struck one of the panel surfaces.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
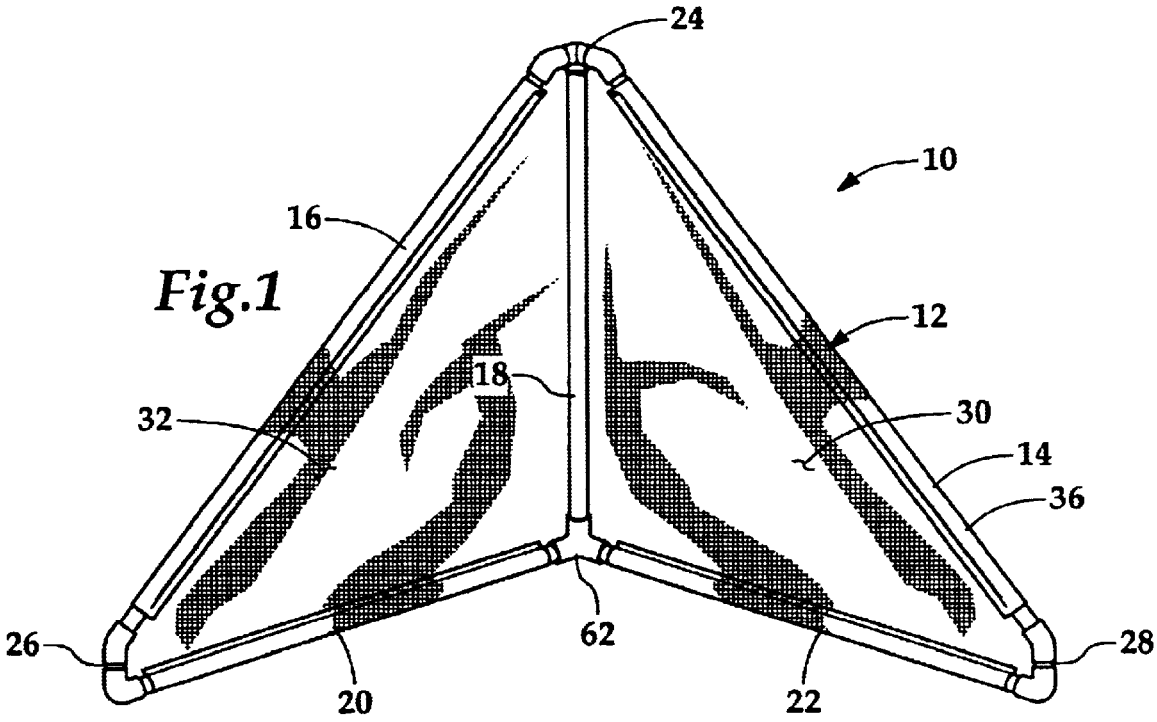
FIG. 1 is a perspective view of an inner upright surfaces of one embodiment of the invention.
Figure 2:
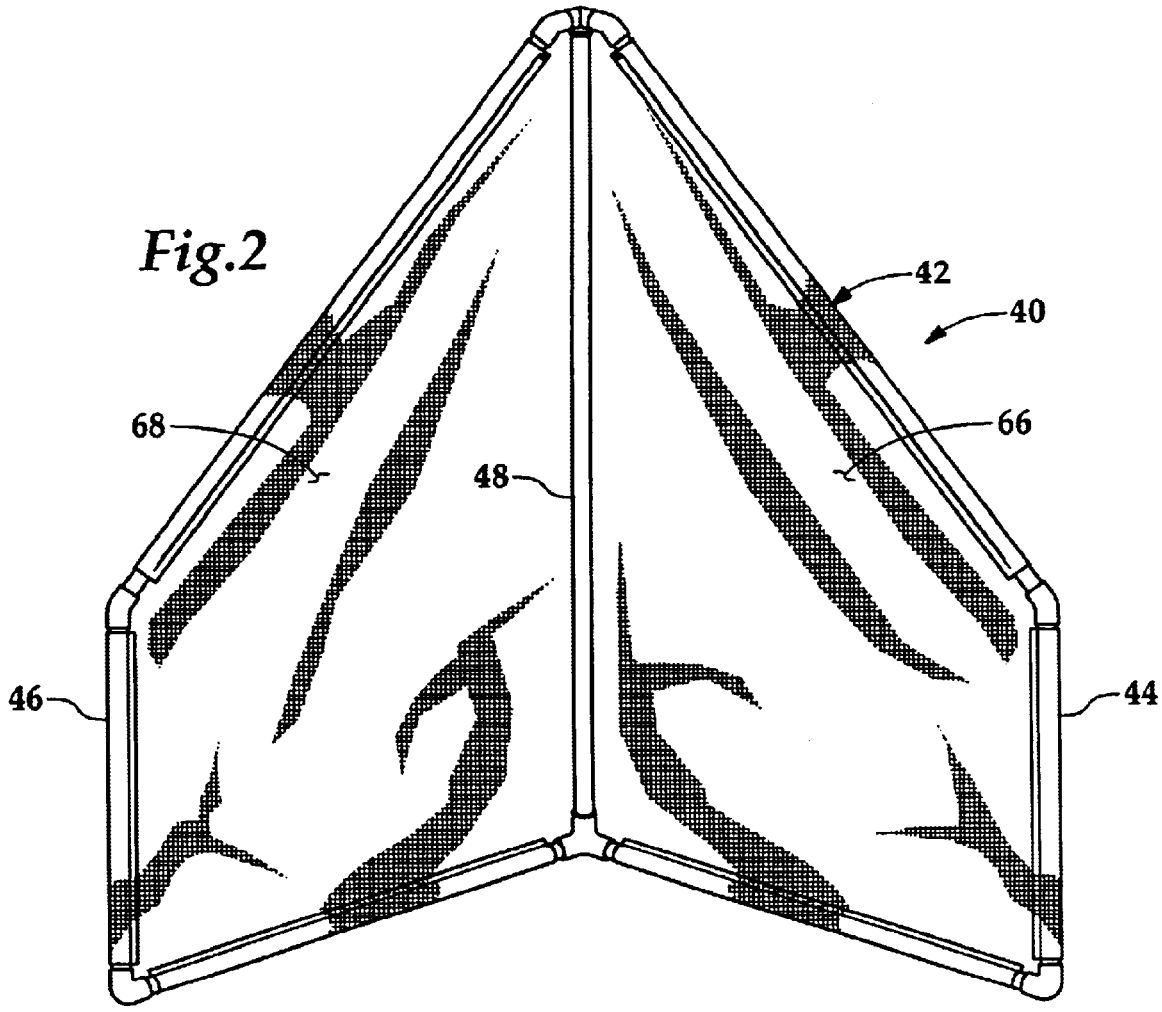
FIG. 2 is a perspective view of the inner upright surfaces of another embodiment of the invention.

Referring now to the drawings, one embodiment of the invention is shown generally at numeral 10 in FIG. 1, while another embodiment of the invention is shown generally at numeral 40 in FIG. 2. Because many of the features described herebelow with respect to the embodiment 10 of FIG. 1 are identical to those shown in the embodiment 40 of FIG. 2, a detailed repetition of those common features is avoided.

Referring specifically to FIGS. 1 and 3 to 6, the embodiment 10 includes a perimeter frame assembly 12 formed of PVC tubing and fittings. The elongated tubular members are formed of the lighter schedule 20 PVC, while the fittings are preferably formed of heavier schedule 40 fittings for added strength at the corners of the perimeter frame assembly 12. The frame assembly 12 includes an upright central frame member 18, diagonally extending tubular frame side members 14 and 16, and lower ground supported lower frame members 20 and 22.

Figure 3:
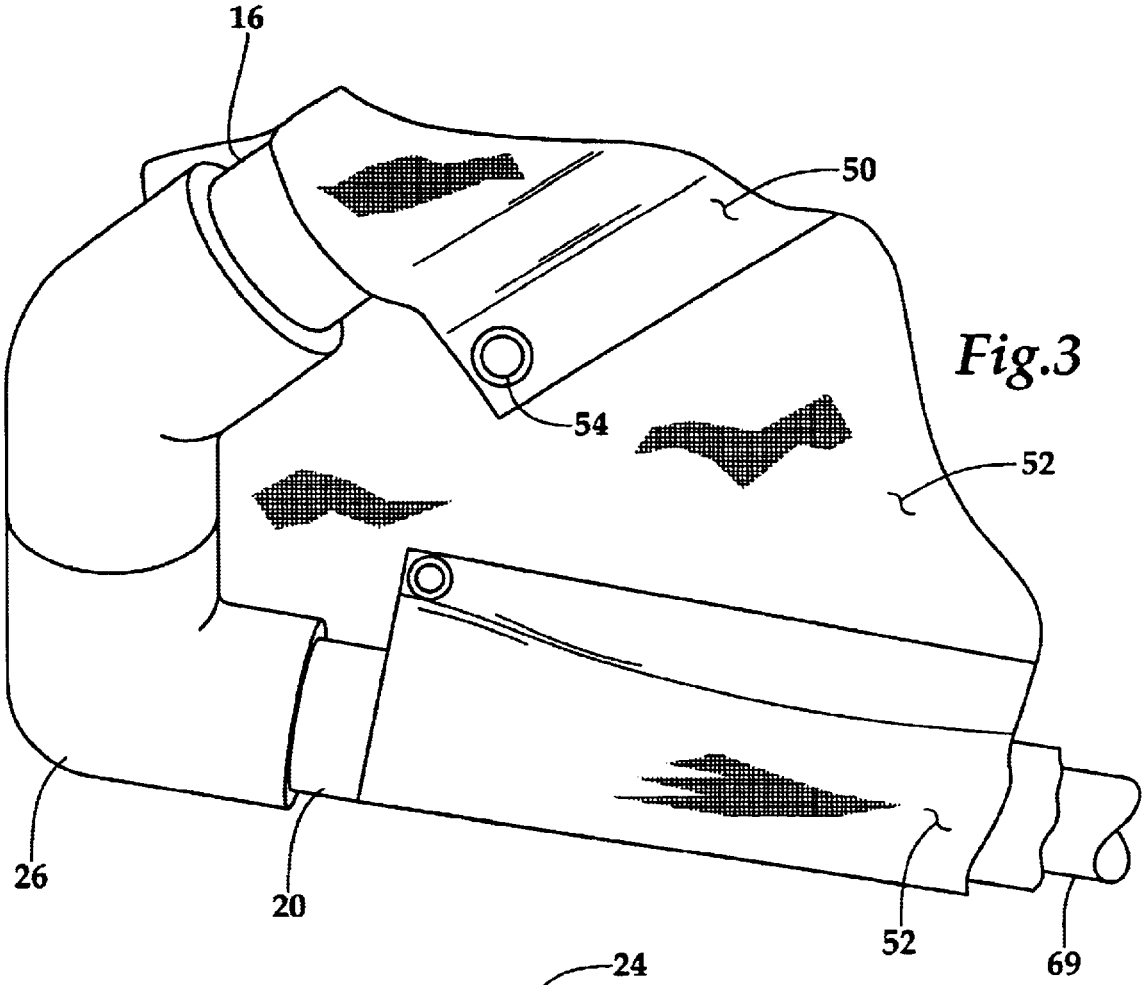
FIG. 3 is an enlarged view of a lower corner of the invention shown in FIG. 1.
Figure 4:
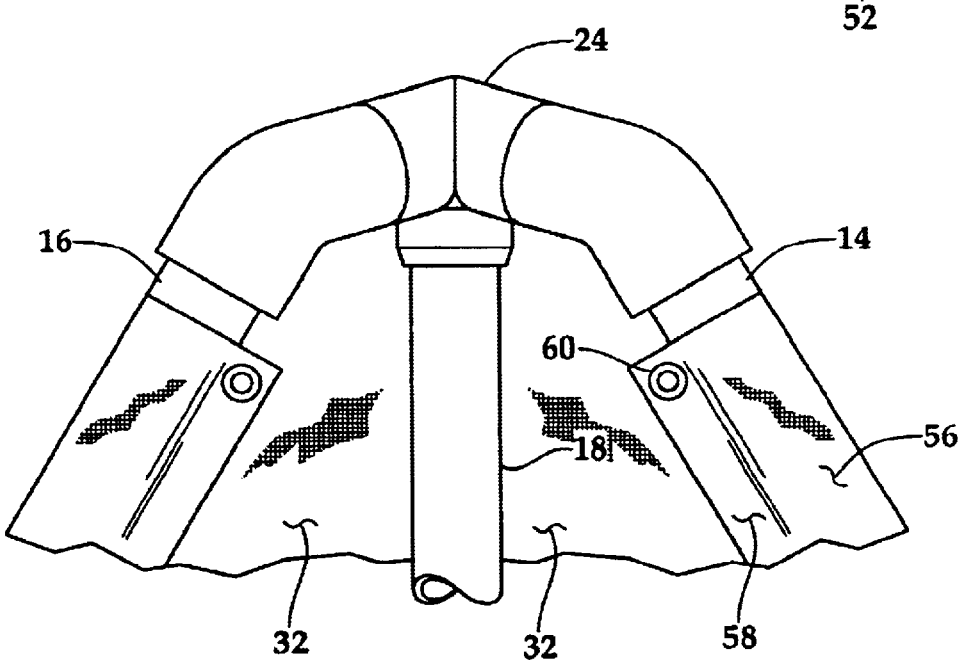
FIG. 4 is an enlarged view of the upper apex of the invention as shown in FIG. 1 and which is similar to that shown in FIG. 2.

As best seen in FIG. 4, the side frame members 14 and 16 and the central upright frame member 18 are jointed at an apex 24 of the frame assembly 12 by the combination of PVC fittings there shown. The lower end of the upright central frame member 18 and the lower ground supported frame members 20 and 22 are connected together at 62 by another appropriate combination of PVC fittings. As best seen in FIG. 3, the side frame members 16 and 14 are connected to the outer ends of the lower frame members 20 and 22 by still another combination of PVC fittings to effect a 45° angular attachment therebetween.

With respect to the embodiment 40 shown in FIG. 2, the frame assembly 42 includes upright edge frame members 44 and 46 and an elongated central frame member 48 which in essence increases the overall height of the bunker 40 by approximately 2½' over the overall of 5' of the embodiment 10 shown in FIG. 1. The lower frame members 20 and 22 of embodiment 10 are established at 5', the corresponding lower frame members of the embodiment 42 being equal thereto. Viewed another way, the panels 66 and 68 are formed as right angle trapezoids with the side frame members at 45°.

Figure 5:
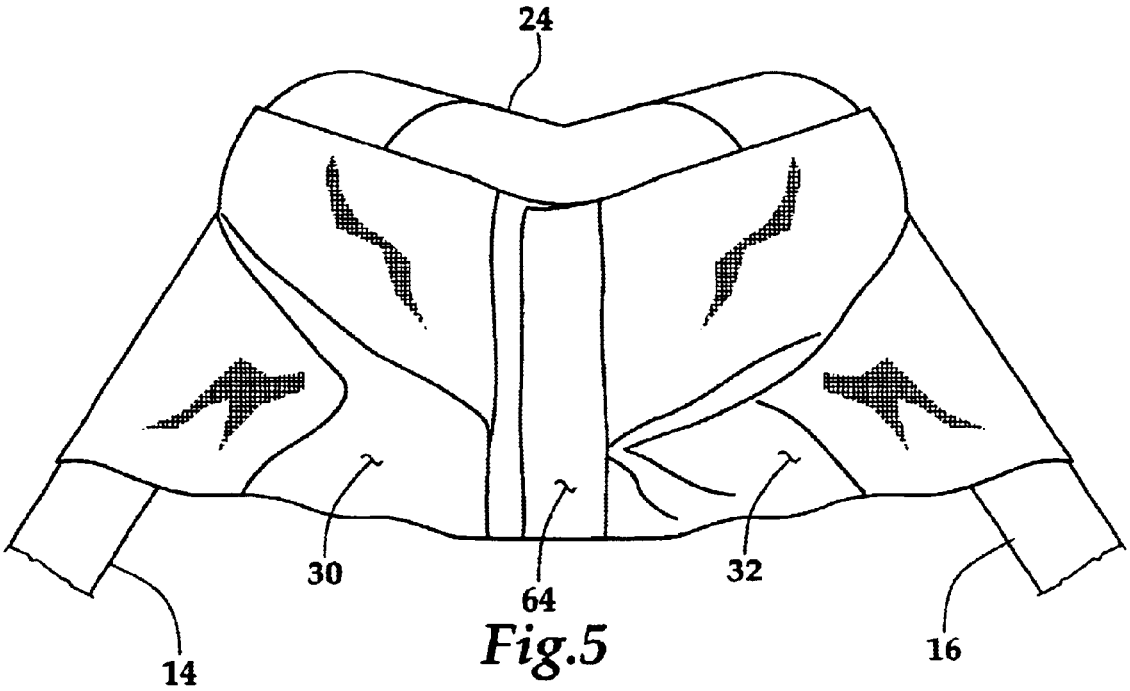
FIG. 5 is an enlarged view of the outer surface of the apex shown in FIG. 1 and FIG. 2.
Figure 9:
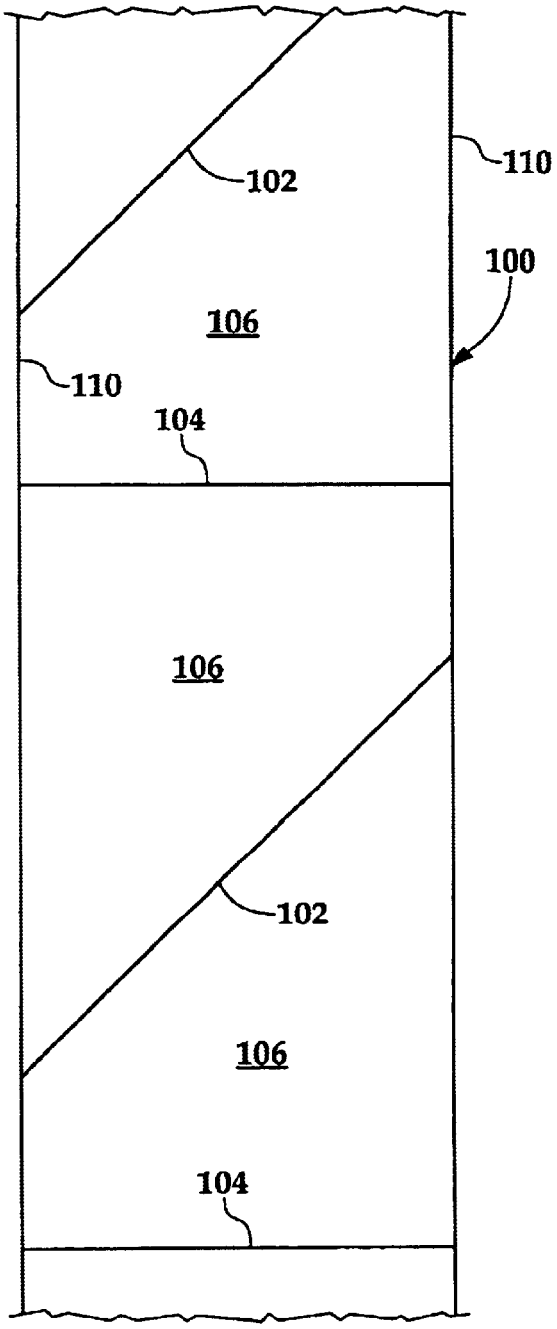
FIGS. 9 and 10 depict the efficient cutting of a length of roll-stored material into the panels used to form the flexible cover of each of the embodiments of FIGS. 2 and 1, respectively.
Figure 10:
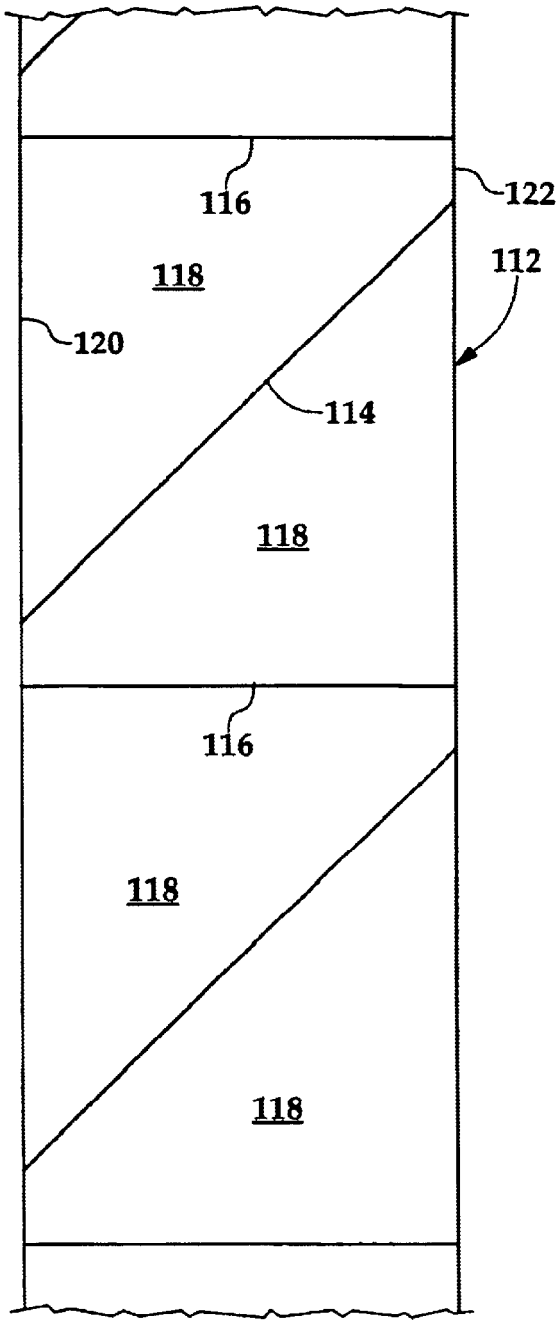

A flexible cover is also provided which is formed of two separate flexible panels 30 and 32 which are connected together along an upright overlapping seam or margin 64 seen in FIG. 5. This cover is formed of sheets of flexible 10 oz vinyl coated polyester which is supplied preferably in roll form by TVF, Inc. of Carmel, Ind., style number VCP-10LQ. To form each of the flexible panels 30 and 32 and panels 66 and 68 of the embodiment 40 of FIG. 2, rolls of the above described vinyl coated polyester material are cut as shown in FIGS. 9 and 10. By biased cutting each of the roll segments 110 and 122 on a 45° bias at 102 and 114, respectively and then forming a transverse cut at 104 and 116, respectively, the blanks 106 and 118 are formed which are used to form the panels 66/68 and 30/32, respectively.

Figure 7:
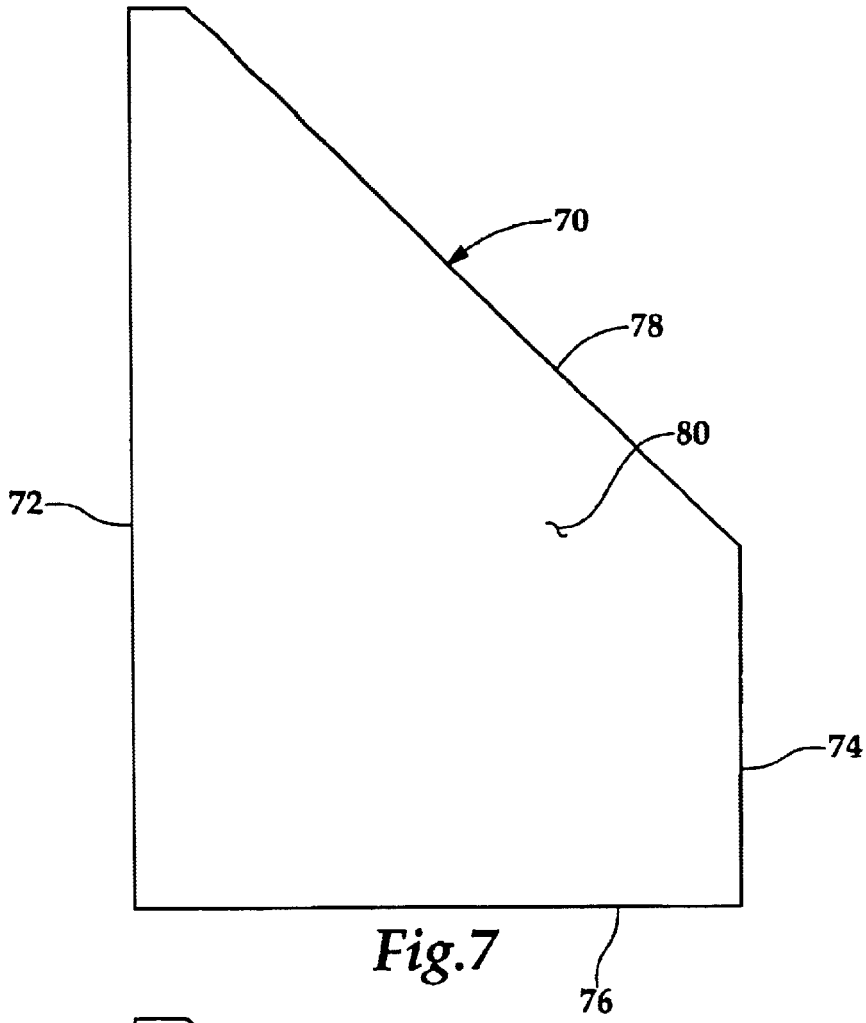
FIG. 7 is a schematic side elevation view of one of the two panels of the embodiment shown in FIG. 2.
Figure 8:
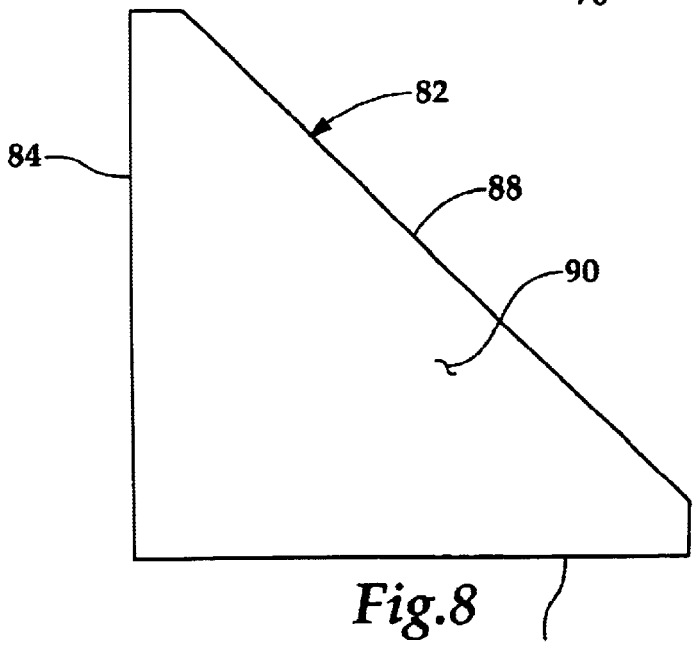
FIG. 8 is a simplistic side elevation view of one of the two panels of the embodiment shown in FIG. 1.

As seen in FIGS. 7 and 8, a side elevation view of each of these side panels shown schematically at 80 and 90 with elongated central margins 72 and 84 establish the overall height of each of these embodiments 70 and 82. Side margins 78 and 88, respectively, are established to be 45° with respect to the central margins 72 and 84, respectively, and form a 45° acute angle with respect to the lower margins 76 and 86, respectively. Again, upright outer margin 74 is provided with respect to the embodiment 70 of FIG. 7 to increase the overall height of that embodiment 70.

Referring particularly to FIGS. 3 to 6, details of the formation and attachment of the cover and its flexible panels 30 and 32 and corresponding panels 66 and 68 with respect to embodiments 40 and 42 are there shown. Elongated pockets shown typically at 52 and 56 are formed by doubling the edge material over as a hem for attachment of the glued hem 50 and 58, respectively of the edge margins of each of the panels 30 and 32. HH-66 vinyl cement is used. Reinforcement is provided in the form of #2 metal grommets shown typically at 54 and 60 for added strength. The placement of these grommets 54 and 60 also facilitate linking or temporarily attaching two or more similar bunkers together to create complex bunker shapes. Short 8" bungee cords (not shown) may be provided for this purpose. The corresponding tubular frame members 14, 16, 20 and 22 are inserted through these elongated pockets as the invention is deployed and the frame assemblies 12 and 42 are assembled.

Figure 6:
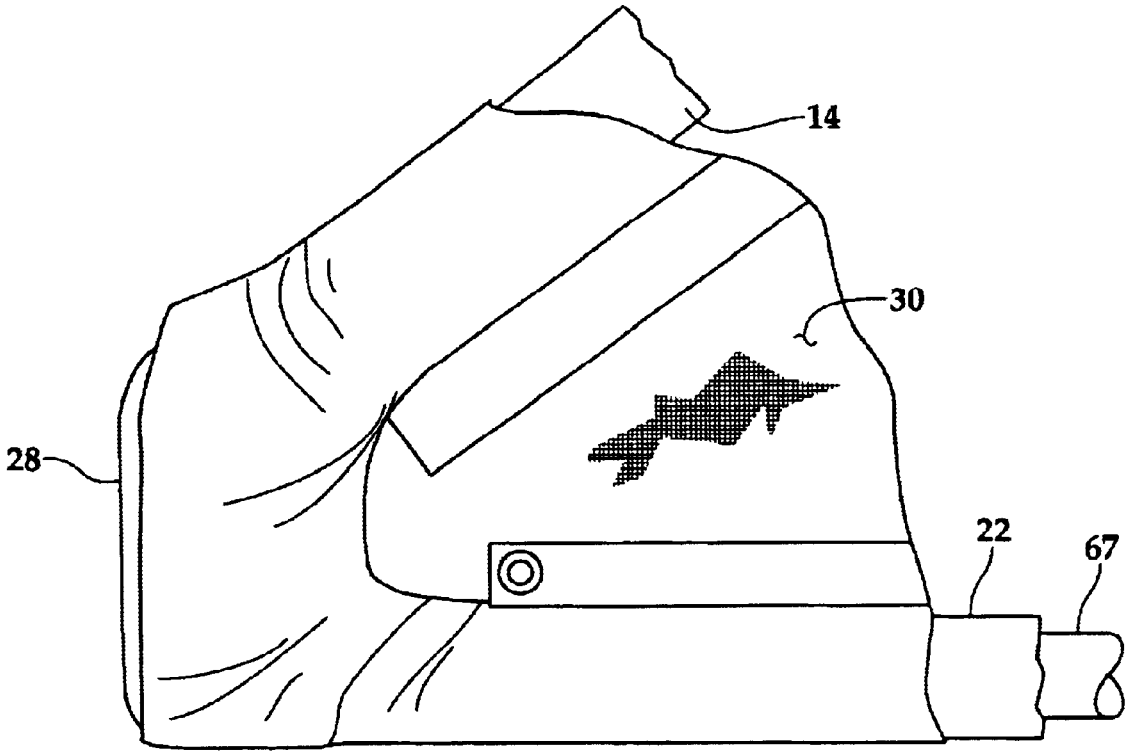
FIG. 6 is an enlarged view of the outer surface of FIG. 3.

It is important to note that, as best seen in FIGS. 1 and 2, each of the flexible panels 30, 32, 66 and 68 are slightly larger than the corresponding opening defined by the frame assemblies 12 and 42, respectively. The sag is shown most dearly in FIGS. 1 and 2 and is provide so that a propelled paintball, particularly at closer range, will not damage or pierce through the fabric when struck by the paintball. Additionally, the energy of a propelled paintball striking these somewhat sagging panels, will more effectively-be dissipated, particularly in a ricochet or glancing strike of the propelled paintball to reduce the likelihood of an inadvertent player strike due to the ricochet. This feature of the less-than-fully tensioned fabric forming the panels 30, 32, 66 and 68 facilitates the use of lighter more flexible fabric for both economy and ease of deployment As best seen in FIGS. 3 and 6, the lower tubular frame members 20 and 22 are weighted by an elongated length of steel or rebar reinforcement 67 and 69. By selecting the diameter or size of the elongated weighted rods 67 and 69 to be as large as possible, preferably 54" long, to fit into the I.D. of the 1" PVC tubing used to form the lower frame members 20 and 22, substantially 50% of the weight of the entire frame assembly 12 and 42 will be centered at the ground or support level of each of the bunkers 10 and 40 to enhance stability.

By deriving the economy of the present invention from the utilization of conventional PVC-type fittings as seen in FIGS. 3 to 6, the orthogonal relationship between each of the panels 30 and 32 and 66 and 68 is established. Likewise the side margins 14 and 16 and the corresponding side margins of the embodiment 40 are likewise established at 45° with respect to the upright central frame members 18 and 48, respectively and the horizontal ground supported frame members 20 and 22.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A portable paintball bunker for temporary deployment atop a playing surface of a paintball game field to protect a player from being hit by a paintball shot from a paintball marker of an opposing player, comprising:

a frame assembly formed of straight tubular frame members including one central upright frame member, two diagonal upper edge frame members and two lower ground-supported frame members and connecting fittings for attaching ends of said tubular frame members together to define two substantially upright planar right triangular shaped perimeter frames having a common upright edge therebetween defined by said central upright frame member;

a flexible cover including two substantially right triangular panels having a common upright margin and each being sized and shaped to extend over one of said perimeter frames, edge margins of said cover having longitudinal pockets formed to receive one corresponding said frame member inserted therein whereby said cover is held and supported by said frame assembly with said upright margin positioned against said central upright frame member;

each of said panels also sized overall to be slightly larger than each said perimeter frame causing each said panel to slightly sag and be untensioned whereby risk of damage caused by propelled paintballs striking thereagainst is substantially reduced.

2. A portable paintball bunker as set forth in claim 1, wherein:

each diagonal side margin of each said side panels and the corresponding said frame members of said frame assembly terminate at an upright end margin and corresponding upright end tubular frame member whereby the overall shape of each said panel is that of a trapezoid.

3. A portable paintball bunker as set forth in claim 1, wherein:

said lower frame members are weighted for added stability.

4. A portable paintball bunker for deployment atop a playing surface of a paintball game field to protect a player from being hit by a paintball shot from a paintball marker of an opposing player during play, comprising:

a tubular frame assembly including two substantially upright planar right triangular shaped perimeter frames having a common upright central edge therebetween;

a flexible cover including two substantially right triangular panels having a common upright margin and each being sized and shaped similar to, and extending over each of the said perimeter frames, edge margins of said cover having elongated pockets formed therealong to receive corresponding tubular members of said frame assembly inserted therein whereby said cover is held and supported by said frame assembly with said upright margin positioned against said central upright frame member;

each of said panels being sized to sag slightly and be untensioned whereby risk of damage caused by propelled paintballs striking thereagainst is substantially reduced.

5. A portable paintball bunker as set forth in claim 3, wherein:

each diagonal side margin of each said side panels and the corresponding said frame members of said frame assembly terminate at an upright end margin in and corresponding upright end tubular frame member whereby the overall shape of each said panel is that of a trapezoid.

6. A portable paintball bunker as set forth in claim 3, wherein:

said lower frame members are weighted for added stability.

* * * * *